US006484637B2

(12) United States Patent
Lewis

(10) Patent No.: US 6,484,637 B2
(45) Date of Patent: Nov. 26, 2002

(54) LITHOGRAPHIC IMAGING WITH PRINTING MEMBERS HAVING ENHANCED-PERFORMANCE IMAGING LAYERS

(75) Inventor: Thomas E. Lewis, East Hampstead, NH (US)

(73) Assignee: Presstek, Inc., Hudson, NH (US)

( * ) Notice: Subject to any disclaimer, the term of this patent is extended or adjusted under 35 U.S.C. 154(b) by 11 days.

(21) Appl. No.: 09/757,231

(22) Filed: Jan. 9, 2001

(65) Prior Publication Data

US 2002/0124755 A1 Sep. 12, 2002

(51) Int. Cl.[7] ..... B41N 1/08
(52) U.S. Cl. ..... 101/456; 101/457; 101/467
(58) Field of Search ..... 101/456, 457, 101/462, 465, 466, 467; 430/302, 290

(56) References Cited

U.S. PATENT DOCUMENTS

| | | | | | |
|---|---|---|---|---|---|
| 3,615,443 | A | * | 10/1971 | Smith | 430/302 |
| 3,663,289 | A | * | 5/1972 | Newman | 101/453 |
| 3,962,513 | A | | 6/1976 | Eames | 101/470 |
| 4,230,792 | A | * | 10/1980 | Tsubai et al. | 101/456 |
| 4,272,604 | A | * | 6/1981 | Meador et al. | 101/467 |
| 5,200,294 | A | * | 4/1993 | De Keyzer et al. | 430/302 |
| 5,339,737 | A | | 8/1994 | Lewis et al. | 101/454 |
| 5,345,869 | A | * | 9/1994 | Treverton et al. | 101/456 |
| 5,418,115 | A | * | 5/1995 | Tsubai et al. | 430/302 |
| 5,570,636 | A | | 11/1996 | Lewis | 101/454 |
| 5,704,291 | A | * | 1/1998 | Lewis | 101/457 |
| 5,996,498 | A | | 12/1999 | Lewis | 101/467 |
| 6,006,667 | A | | 12/1999 | Lewis | 101/462 |
| 6,014,929 | A | * | 1/2000 | Teng | 101/456 |
| 6,055,906 | A | | 5/2000 | Lewis | 101/467 |
| 6,085,656 | A | | 7/2000 | Lewis | 101/460 |
| 6,114,094 | A | * | 9/2000 | Ishiguro et al. | 430/302 |

* cited by examiner

*Primary Examiner*—Stephen R. Funk
(74) *Attorney, Agent, or Firm*—Testa, Hurwitz & Thibeault, LLP

(57) ABSTRACT

Lithographic plate constructions include imaging layers having dispersed therein a radiation-scattering material and a radiation-absorbing material, both of which cooperate to increase the overall absorption of radiation in that layer. The radiation-scattering material may be in particulate form, the particles reflecting the imaging radiation from their surfaces. The use of particulate scattering material within the imaging layer creates a highly porous matrix that favors deep penetration of the imaging radiation and mechanical locking of the imaging layer to one or both adjacent layers. The scattering material may also be chosen also for its ability to chemically bind with an adjacent layer to increase intercoat adhesion.

35 Claims, 5 Drawing Sheets

LITHOGRAPHIC IMAGING WITH PRINTING MEMBERS HAVING ENHANCED-PERFORMANCE IMAGING LAYERS

BACKGROUND OF THE INVENTION

1. Field of the Invention

The present invention relates to digital printing apparatus and methods, and more particularly to lithographic printing-plate constructions for on- or off-press imaging using digitally controlled laser output.

2. Description of the Related Art

In offset lithography, a printable image is present on a printing member as a pattern of ink-accepting (oleophilic) and ink-repellent (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The ink-repellent fountain solution prevents ink from adhering to the non-image areas, but does not affect the oleophilic character of the image areas.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include various forms of lasers. For example, U.S. Pat. Nos. 5,351,617 and 5,385,092 (the entire disclosures of which are hereby incorporated by reference) describe an ablative recording system that uses low-power laser discharges to remove, in an imagewise pattern, one or more layers of a blank lithographic printing plate, thereby creating a ready-to-ink printing member without the need for photographic development. In accordance with those systems, laser output is guided from the diode to the printing plate and focused onto its surface (or, desirably, onto the layer most susceptible to laser ablation, which will generally lie beneath the first surface layer).

U.S. Pat. Nos. 5,807,658, 5,783,364 (the '364 patent), 5,339,737 (the '737 patent), and Re. 35,512 (the '512 patent), the entire disclosures of which are hereby incorporated by reference, describe a variety of lithographic plate configurations for use with such imaging apparatus. In general, the plate constructions may include a first, topmost layer chosen for its affinity for (or repulsion of) either ink or an ink-repellent fluid. Underlying the first layer is an imaging layer, which ablates in response to imaging (e.g., infrared, or "IR") radiation. A strong, durable substrate underlies the imaging layer, and is characterized by an affinity for (or repulsion of) either ink or an ink-repellent fluid opposite to that of the first layer. Ablation of the absorbing second layer by an imaging radiation pulse generally weakens the topmost layer as well. By disrupting its anchorage to an underlying layer, the topmost layer is rendered easily removable in a post-imaging cleaning step. This creates an image spot having an affinity differing from that of the unexposed first layer, for either ink or an ink-repellent fluid, the pattern of such spots on a lithographic plate forming an image. Laser imageable materials may be imaged by pulses of near infrared (near IR) radiation from inexpensive solid-state lasers. Such materials typically exhibit a nonlinear response to near-IR exposure, namely, a relatively sharp imaging-fluence threshold for short-duration laser pulses, but essentially no response to visible light. A longstanding goal of plate designers is to increase responsiveness to imaging radiation while maintaining desirable properties such as durability, manufacturability, and internal compatibility.

One strategy frequently proposed in connection with photothermal materials is incorporation of energetic (e.g., self-oxidizing) compositions, which, in effect, contribute chemical energy to the imaging process. For example, the '737 patent mentioned above discloses nitrocellulose layers that undergo energetic chemical decomposition in response to heating. Unfortunately, these materials do not help to concentrate radiation within the imaging layer or increase the efficiency of its utilization. Instead, they are either employed as essentially interchangeable alternatives to non-energetic materials, or as propellent layers in transfer-type materials (see, e.g., U.S. Pat. Nos. 5,308,737, 5,278,023, 5,156,938 and 5,171,650).

Other reported plate constructions, such as in U.S. Pat. No. 5,570,636 (the '636 patent) the entire disclosure of which is hereby incorporated by reference, have a support layer that reflects the imaging radiation. In these constructions, the radiation from a laser pulse that passes through the imaging layer is returned to augment the effective flux through that layer and thus the efficiency of the imaging process.

While these constructions concentrate radiation within the imaging layer, they do not affect the efficiency with which radiation is distributed in that layer. Incident and reflected radiation follows the same, essentially straight-line path through the layer thickness. If, for example, the radiation-absorptive material is unevenly dispersed throughout the imaging layer, largely transparent regions will receive the same amount of radiation as densely absorptive regions, with consequent waste of laser power.

BRIEF SUMMARY OF THE INVENTION

The present invention is directed to lithographic plate constructions having imaging layers that increase the distribution of imaging radiation within those layers, thereby improving the efficiency with which laser power is utilized. The present invention is also directed to methods of imaging lithographic plate constructions having such layers.

The present invention exploits the combination of a radiation-scattering material and a radiation-absorbing material dispersed in the imaging layer to increase the overall absorption of radiation in that layer. The radiation-scattering material may be in particulate form such that the particles reflect the radiation from their surfaces. Alternatively, the particles may scatter radiation through other optical properties such as, for example, diffraction. The presence of these particles dispersed within the imaging layer creates a large number of surfaces that reflect incident radiation at many angles throughout that layer. The overall effect is the scattering of radiation within the imaging layer. The radiation-absorbing material, also dispersed in the imaging layer, is thus exposed to incident radiation from the radiation source as well as the scattered radiation from within the imaging layer. This increased exposure of the radiation-absorbing material increases the efficiency and speed of ablation of the imaging layer.

The use of particles for the radiation-scattering material also provides beneficial porosity to the imaging layer. This porosity enhances adhesion to the overlying and/or the underlying layer and increases radiation penetration within the imaging layer.

The plates of the present invention can be either "positive-working" or "negative-working." In positive-working versions, areas that are inherently ink-receptive receive laser output and are removed, revealing a hydrophilic (or oleophobic) layer that will repel ink during printing; accordingly, the image area is selectively removed to reveal the background. In negative-working versions, areas that are inherently hydrophilic (or oleophobic) are removed to reveal an underlying ink-receptive layer, such that the exposed area forms the image and the unremoved top layer forms the background. An especially preferred construction is a "dry" plate with a silicone or fluorocarbon topcoat.

The radiation-scattering and radiation-absorbing materials may be in the form of powders, aggregates, or dyes, and are dispersed within the imaging layer. (As used herein, the terms "dispersed" and "dispersion" refer to any form of distribution within the imaging layer, e.g.,. conventional colloidal dispersions or suspensions of particles, solutions of a dye, distribution of material through codeposition as described below, etc.) The dispersion of these materials is immobilized through the use of a polymeric imaging layer, which may optionally be crosslinked in order to improve performance.

Alternatively, the imaging layer may be built up by deposit of polymer precursors, in which case the radiation-scattering and/or radiation-absorbing materials may be codeposited therewith. This approach facilitates creation of graded layers in which the concentration of radiation-scattering and/or radiation-absorbing material varies through the thickness of the layer, or is concentrated in one or more interlayers.

In one embodiment, the radiation-scattering material is a metal oxide, such as titanium oxide, tin dioxide, or zirconium oxide. In another embodiment, the radiation-scattering material comprises metallic particles (e.g., titanium, aluminum, magnesium, or other suitable metal).

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Representative printing members in accordance with the present invention are illustrated in FIGS. 1, 2, 3 and 4. As used herein, the term "plate" or "member" refers to any type of printing member or surface capable of recording an image defined by layers exhibiting differential affinities for ink and/or fountain solution which repels ink; suitable configurations include the traditional planar lithographic plates that are mounted on the plate cylinder of a printing press, but can also include cylinders (e.g., the roll surface of a plate cylinder), an endless belt, or other arrangements.

Figure 1:
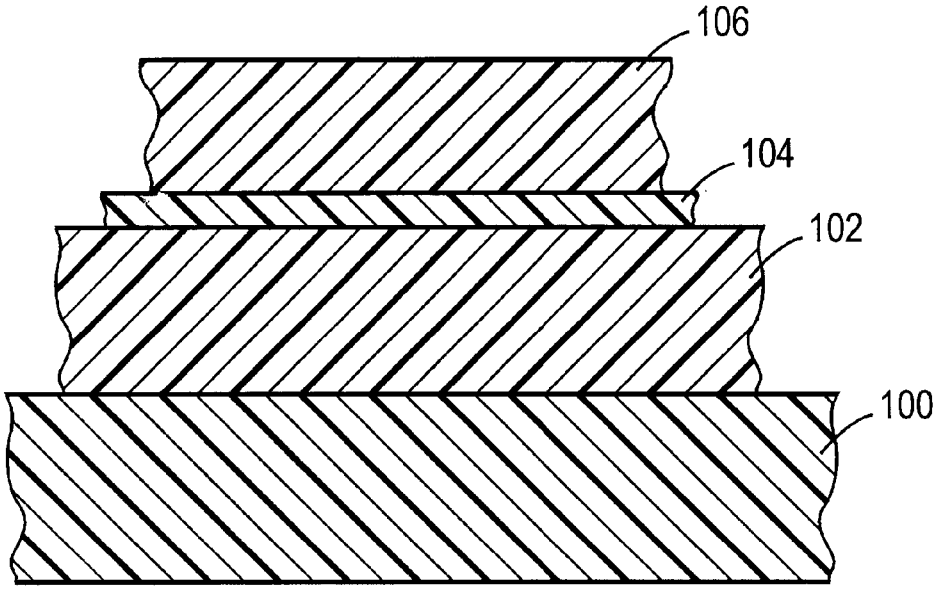
FIG. 1 is an enlarged sectional view of a lithographic plate having a silicone topmost layer, an imaging layer in accordance with the instant invention, an ink-accepting first layer, and a substrate.
Figure 2:
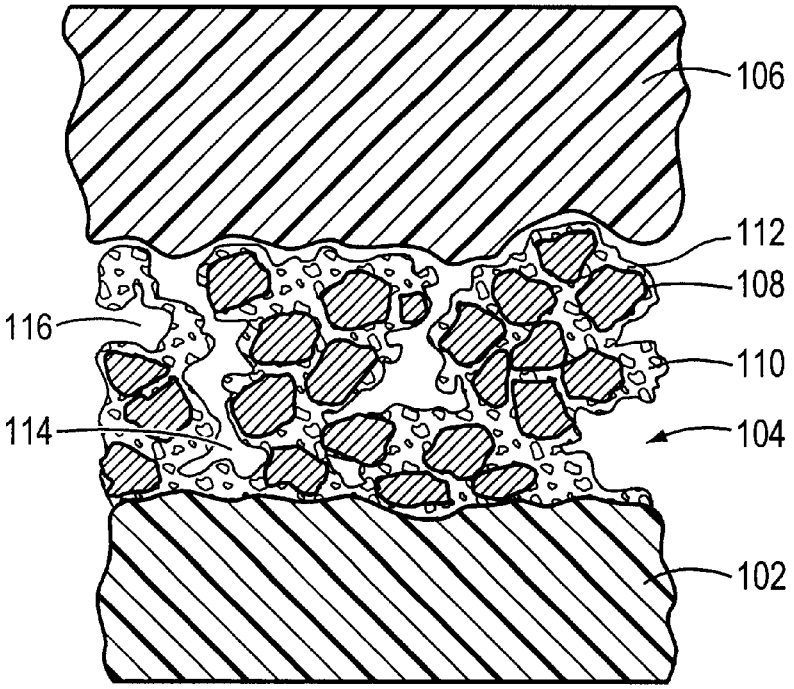
FIG. 2 is an enlarged sectional view of a lithographic plate showing the microscopic morphological details of an imaging layer according to the present invention.
Figure 3:
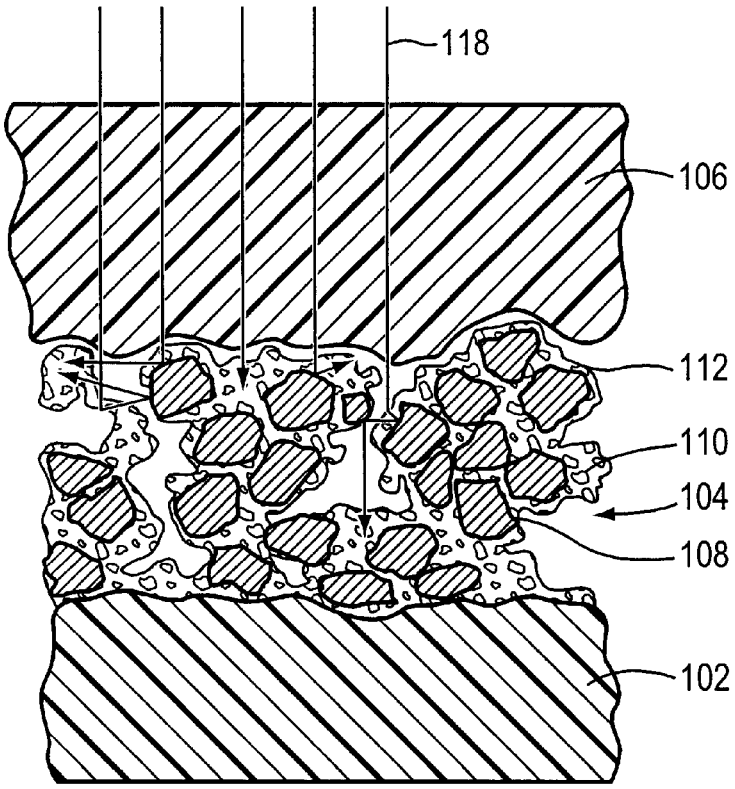
FIG. 3 is an enlarged sectional view of the lithographic plate of FIG. 2 illustrating the scattering of incident collimated radiation in the imaging layer according to the present invention.

With reference to FIG. 1, a printing member in accordance with the present invention may include a substrate 100 (which is optional), a first layer 102, an imaging layer 104, and a surface layer 106.

In general, in dry-plate printing plates, surface layer 106 is generally a silicone polymer or fluoropolymer that repels ink, while layer 102 is oleophilic and accepts ink. Layer 104 absorbs radiation and ablates in response to imaging radiation. Following exposure to radiation, layer 106 is ultimately removed with layer 104 in the exposed regions, revealing layer 102.

The characteristics of optional substrate 100 depend on the type of printing application. If rigidity and dimensional stability are important, substrate 100 can be a metal, e.g., an aluminum sheet. Ideally, the aluminum is polished so as to reflect back into the imaging layer 104 any radiation passing through the overlying layers. Alternatively, layer 100 may be a polymer film.

Layer 102 can be a polymer, as illustrated, such as a polyester film; once again, the thickness of the film is determined largely by the application (and whether or not a substrate 100 is employed). A representative thickness range is 0.001 to 0.015 inch, with 0.005 to 0.007 inch preferred. The film may, if desired, be gloss-controlled and/or colored. For example, the benefits of reflectivity can be retained without the use of a metallic substrate 100 by using as layer 102 a polymeric material containing a pigment that reflects imaging (e.g., IR) radiation. A material suitable for use in an IR-reflective layer 102 is the white 329 film supplied by ICI Films, Wilmington, Del., which utilizes IR-reflective barium sulfate as a white pigment. A preferred thickness is 0.007 inch. If desired, a polymeric substrate 102 can be laminated to a metallic substrate 100, in which case a thickness of 0.002 inch is preferred. As disclosed in the '636 patent, the metallic substrate 100, or a laminating adhesive between layers 100 and 102, can reflect the imaging radiation. Layer 102 can also maintain chemical and physical integrity notwithstanding the effects of imaging radiation and ablation of the overlying layer 104. For example, layer 102 may be a highly crosslinked polymer exhibiting substantial resistance to heat. Alternatively, other refractory, heat-resistant, oleophilic materials such as ceramics can instead overlay layer 102. The choice of material is generally dictated by considerations relating to application technique, economics, and maximum desired thickness.

In another approach, layer 102 can be a metal sheet. In this case, layer 104 serves as a printing layer rather than layer 102, and has a lithographic affinity opposite that of layer 106. Layer 104 is also sufficiently thick to provide thermal insulation, preventing heat from being lost into metal layer 102, and ablates only partially in response to imaging radiation (so that the unablated thickness of layer 104 serves as a printing layer). The insulating role of layer 104 is assisted by the presence therein of radiation-scattering material, which tends to concentrate imaging radiation toward the top of that layer and away from layer 102.

Metal layers 102 can be fabricated from, for example, aluminum, steel, nickel or alloys. A preferred thickness range for a metal layer 102 is 0.004 to 0.020 inch, with 0.006 to 0.012 inch being preferred. Any of various well-known primers can be used to anchor layer 104 to a metal layer 102. Metal layer 102 may have a textured surface, which can assist with anchorage to overlying layers. Anodic stabilization, graining or other treatments are commonly applied to aluminum supports used for lithographic printing plates. Layer 104 is an imaging layer that ablates (at least partially) in response to absorption of radiation. In imaging layers of the present invention, and with reference to FIG. 2, layer 104 includes a radiation-scattering material 108 and a radiation-absorbing material 110, both dispersed in a polymeric material 112. Scattering material 108 is preferably particulate. Absorbing material 110 may also be particulate, but need not be; for example, material 110 may be an IR-absorbing dye. Thus, scattering material 108 predominantly contributes to the formation of a highly porous layer. Cohesion of layer 104 is maintained by the polymeric material 112 which binds the particulate materials 108 and 110 (if the latter is in particulate form) together with the other components into an internally cohesive, adherent layer. The morphology of the resulting layer 104 shows towers and aggregates of particulate materials encased within the polymeric material, forming deep grooves 114 and pores 116. The presence of these grooves and pores within layer 104 permits the penetration of the imaging radiation 118 deep into that layer. The porous structure of layer 104 also facilitates adhesion of the top layer 106 by mechanical locking between the two layers.

Effective radiation-scattering materials 108 are generally pigments that mostly reflect the selected laser radiation, and more particularly IR radiation for use with IR diode lasers as radiation sources. It is envisioned that pigments which reflect other wavelengths can be utilized with lasers emitting at those wavelengths. Preferably, the refractive index of the reflective pigment differs substantially from that of the surrounding polymer 112, at least at the imaging wavelength. Suitable IR-reflective pigments include, but are not limited to, metal oxides such as titanium dioxide ($TiO_2$), tin dioxide ($SnO_2$), zirconium dioxide ($ZrO_2$), or zinc oxide (ZnO).

Other non-metallic oxides and other white pigments such as barium sulfate ($BaSO_4$) may be suitable, although thermal decomposition of the sulfate ions would possibly yield various obnoxious sulfoxide emissions. Titanium oxide and silica-treated reflective pigments are particularly suitable materials as they are also available in various hydrated forms (i.e., $(TiO_2)_n$–OH or $(SiO_2)_n$–OH). These hydrated forms enhance adhesion by forming covalent bonds with the silicone in the top layer-the hydroxyl groups on the hydrated titanium oxide or silica react with the hydrosilyl functional groups (Si-H) of the silane precursor to the silicone polymer and form stable covalent bonds.

Still other suitable materials include reflective particles, e.g., metal particles or flakes, glass retroflector spheres, or particles coated with a reflective material, or conventional pigment particles surrounded with an outer clear shell, which acts as a reflector.

The average size of the radiation-scattering particles is not critical, although the particles are preferably be smaller than the thickness of the coating in which they are dispersed. A representative range of acceptable sizes for typical applications is 0.1 to 2.5 $\mu$m in average diameter.

Effective radiation absorbers are materials capable of absorbing the selected laser radiation. In the case of an IR laser, suitable materials include, but are not limited to, carbon black, conductive or non-conductive, and soluble dyes such as, but not limited to, phthalocyanines and naphthalocyanines. In contrast to the radiation-scattering material 108, the radiation-absorbing material 110 need not be a particulate material, but may instead be a material that is soluble in either the polymeric material or in the solvent used in the preparation of the imaging layer. Indeed, absorbing material 110 may even be incorporated chemically within the backbone of polymeric material 112.

The radiation-scattering and/or radiation-absorbing materials can, if desired, be deposited in a graded fashion. For example, as described in allowed application serial no. 09/272,654, filed on Mar. 19, 1999, now U.S. Pat. No. 6,207,349, and entitled LITHOGRAPHIC IMAGING WITH CONSTRUCTIONS HAVING MIXED ORGANIC/INORGANIC LAYERS (the entire disclosure of which is hereby incorporated by reference), a graded structure may be built up on a substrate in successive deposition steps. For example, polymer precursors and the particulate materials can be deposited in stages, with each stage containing a desired ratio of polymer to particulates. Suitable polymer precursors include acrylate-functional polymers, acetylene derivatives, azido or azide deriviatives, and nitro-functional compounds.

Figure 5A:
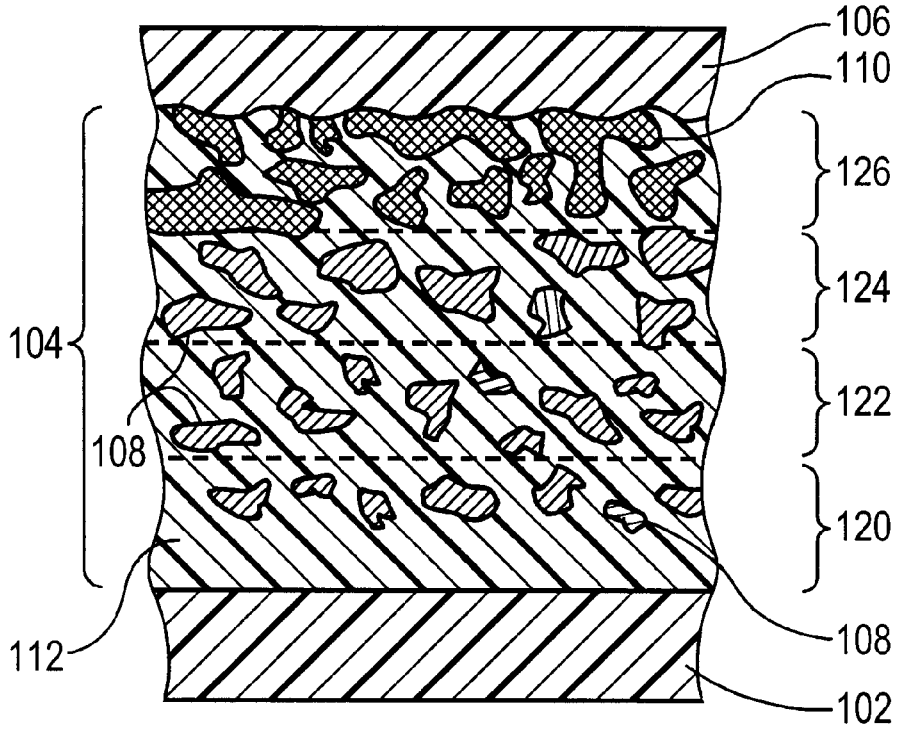
FIGS. 5A and 5B are enlarged sectional views of lithographic plates in which the radiation-scattering and radiation-absorbing materials are deposited in different interlayers along with polymer precursors forming the imaging layer.
Figure 5B:
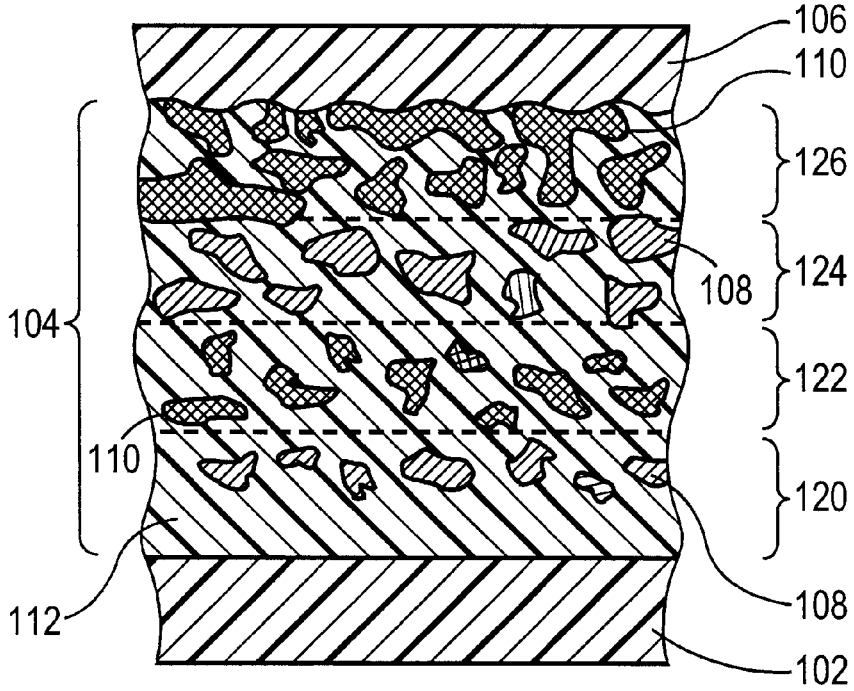

This is illustrated in FIGS. 5A and 5B. In accordance with the embodiment shown in FIG. 5A, a polymer precursor forming a first thickness portion or interlayer 120 of layer 104 is deposited onto first layer 102. Prior to curing, the radiation-scattering material 108 is applied to interlayer 120 in a desired ratio relative to polymer 112. In an uncured state, polymer 112 accepts material 108 and allows it to integrate therein. Particularly when applied by deposition techniques such as reactive sputtering, material 108 can form a pattern of patches or islands over the surface of layer 120, which is then cured.

Application of layer 120 by vapor condensation affords control over the pattern of deposition. Polymer 112 can be applied under conditions that do not permit coalescence and consequent film formation, thereby allowing creation of a discontinuous polymer layer. Material 108 is then deposited over the discontinuous pattern, so that the organic layer is effectively bound within the inorganic material rather than vice versa.

If the interlayers are applied and cured separately, then following deposition and curing of interlayer 120, the process is repeated for subsequent interlayers 122 and 124. Alternatively, the depositions corresponding to the interlayers may be applied before any curing takes place, with the entire structure undergoing curing after the depositions are complete. In either case, different ratios of material 108 to polymer 112 may be present in each of the interlayers. For example, the proportion of material 108 may increase in each stage, resulting in a graded structure with the amount of material 108 increasing away from first layer 102 as illustrated.

Finally, radiation-absorbing material 110 is applied to the uncured material of interlayer 126, so that the radiation-absorbing material is concentrated toward overlying layer 106. Again, interlayer 126 and material 110 can be applied to the underlying interlayers before or after they have been cured.

Alternatively, as shown in FIG. 5B, the interlayers can be loaded alternately with radiation-scattering material 108 and radiation-absorbing material 110.

Figure 6:
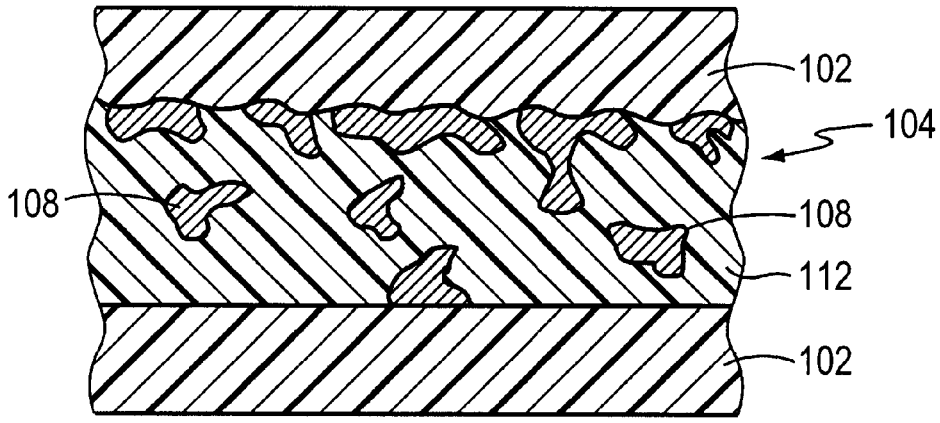
FIG. 6 is an enlarged sectional view of a lithographic plate in which a radiation-scattering material is integrated within the imaging layer following deposition onto that layer.

In another approach discussed in the '349 patent and illustrated in FIG. 6, polymeric material 112 may be softened, and one or more inorganic materials (which may serve as the radiation-scattering material and, optionally, the radiation-absorbing material) are deposited onto a surface of the softened polymer. The inorganic material or materials overspread the surface and integrates within the soft polymeric layer; at this point, it may be desirable to assist the migration of the inorganic material into the polymer (e.g., by charging the inorganic material and applying an opposite charge to a conductor underlying the polymer). The polymer is then cured to immobilize the integrated deposition material, thereby forming a composite. In the illustrated embodiment, the integrated phase is radiation-scattering material 108; radiation-absorptive material 110 may be dispersed as a dissolved dye in polymeric material 112.

Suitable polymeric materials 112 should be capable of binding the radiation-scattering material 108 and the radiation-absorbing material 110 into an adherent, cohesive layer, as well as decomposing upon exposure to high heat. They should also exhibit good durability and not produce significant hazardous decomposition byproducts in response to laser exposure. Representative materials include polymers such as, but are not limited to, nitrocellulose, polyvinyl alcohol (PVOH), and other suitable compositions described in the '737 patent. These polymers are preferably crosslinked. Depending on the type of crosslinking agent used, the polymer may also contain traces of crosslinking catalysts or initiators. Examples of suitable crosslinking agents, catalysts, and initiators are also set forth in the '737 patent. Other suitable energetic polymeric materials are disclosed in U.S. Pat. Nos. 5,459,016; 5,326,619; and 5,278,023.

Conductive polymers, such as polyaniline or polypyrrole as described in the '737 patent, are also suitable as a polymeric material 112. A conductive polymer may constitute the entirety of the composition, or may instead be combined with other polymeric materials (e.g., via in situ formation) such as nitrocellulose.

It should be noted that the range of compositions suitable for use as polymeric material 112 can be expanded through judicious choice of one or both materials dispersed therein. For example, vinyl chloride polymers can produce harmful acidic byproducts, but these can be neutralized through use of calcium carbonate as the radiation-scattering material.

Layer 104 is generally formed by casting from a solvent. A precursor liquid composition includes a solvent in which the components or precursors of the components of layer 104 are either dispersed or dissolved. For example, depending on the nature of the polymeric material and the nature of the crosslinks, the precursor composition may comprise a polymeric crosslinkable material, a crosslinking agent, and an initiator or catalyst for initiating or catalyzing the crosslinking reaction. Alternatively, a monomeric material or a mixture of co-monomers (one of which is polyfunctional to form the crosslinks) may be mixed with polymerization initiators or catalysts to trigger polymerization. The ratio of the reagents may be varied to fine tune the physical and mechanical properties of the resulting layer 104. High loads of a radiation-scattering material 108 that has a low volatility (e.g., $TiO_2$) lead to low proportions of polymeric material 112 and result in imaging layers that produce little emission but may form significant residues.

Following its application to layer 102 (e.g., on a coating line), the precursor composition is cured and dried in a conventional fashion. The morphology of layer 104 presents a highly porous matrix containing grooves 114 and pores 116. The morphology of layer 104 is mostly controlled by the radiation-scattering material 108, since the average sizes of these particles are typically larger than those of the radiation absorbing material 110.

Figure 4:
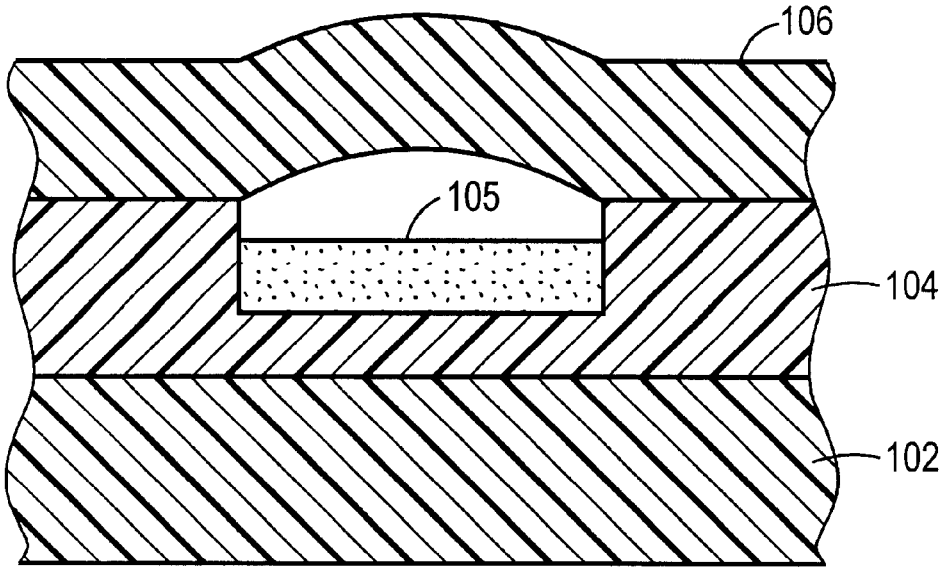
FIG. 4 is an enlarged sectional view of the lithographic plate of FIG. 2 illustrating the morphology of the imaging layer following exposure to radiation according to the present invention.

With reference to FIG. 4, exposure of layer 104 to imaging radiation, such as near-IR laser pulses, ablates a portion of the polymeric component of layer 104 facing the laser source, leaving a layer 105 that may contain byproducts from layer 104, overlying layer 106, the reflective phase, and the near-IR absorber. A portion of the layer 104 opposite the laser source typically survives as a result of internal reflection of the laser pulse within layer 104. Layer 105 (if not removed by cleaning) and/or the exposed surface of the remaining portion of layer 104 have a lithographic affinity opposite to that of top layer 106.

Alternatively, layer 104 may be formulated for non-ablative imaging as set forth in U.S. Pat. No. 6,107,001 (the entire disclosure of which is hereby incorporated by reference). In accordance with this patent, laser-induced heating of layer 104 causes it to undergo irreversible detachment from layer 106, rendering that layer easily removed and allowing layer 104 to serve as a printing surface.

Methods for imaging the lithographic plates of the present invention generally include selectively exposing portions, or at least a portion, of the printing member to laser radiation in a pattern that represents an image such that the radiation penetrates layer 104 and is absorbed by the radiation-absorbing material 110 contained therein. That absorbing material heats up in response to the radiation. Heat dissipation within layer 104 causes some or all of the components of that layer to volatilize, melt, and/or decompose, resulting in ablation or collapse of layer 104. In cases where the layer has a high content of material with low volatility, the residues 105 occupy a lesser volume than layer 104. This leads to the collapse or destabilization of the topmost layer 106. In cases where a gas-forming material is used or when layer 104 includes high-volatility material, a bubble is formed, once again de-anchoring topmost layer 106. In both cases the remnant of layer 106 overlying exposed portions of layer 104 can be removed from the printing member by a subsequent cleaning step which can be as simple as wiping or brushing.

Useful materials for layer 106 and techniques of coating are disclosed in the '737 and '512 patents. Suitable dry-plate printing, oleophobic materials for layer 106 include, but are not limited to, silicones and fluoropolymers. Among the silicones, those with silane functional groups (Si-H) such as "addition-cure" silicones provide for chemical bonding with the pigment(s) in the imaging layer 104 and increased adhesion to that layer. Some "condensation-cure" silicones also based on silane functionality will likewise benefit from bonding to pigment surfaces. This interlayer chemical bonding, as well as the mechanical bonding mentioned above (due to the porosity of layer 104), provides greater adhesion between layers 104, 106 and consequent plate durability. In general, suitable silicone materials are coated and then dried and heat-cured to produce a uniform coating deposited at, for example, 2 g/m$^2$.

Alternatively, layer 106 may be hydrophilic (e.g., polyvinyl alcohol, as described in the '737 patent) to produce a wet plate. In the case of a hydrophilic or oleophobic layer 106, the residues 105 and layer 102 will be oleophilic.

In still another alternative, layer 106 is oleophilic and layer 102 (as well as residues 105) is hydrophilic, thereby producing a positive-working wet plate.

Imaging apparatus suitable for use in conjunction with the present printing members includes at least one laser device that emits in the region of maximum plate responsiveness, i.e., whose $\Lambda_{max}$ closely approximates the wavelength region where the plate absorbs most strongly. Specifications for lasers that emit in the near-IR region are fully described in the '737 and '512 patents; lasers emitting in other regions of the electromagnetic spectrum are well-known to those skilled in the art.

Suitable imaging configurations are also set forth in detail in the '737 and '512 patents. Briefly, laser output can be provided directly to the plate surface via lenses or other optic components, or transmitted to the surface of a blank printing plate from a remotely sited laser using a fiber-optic cable. A controller and associated-positioning hardware maintains the beam output at a precise orientation with respect to the plate surface, scans the output over the surface, and activates the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor (RIP) or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length). Off-press applications, which can be designed to accommodate very rapid plate movement (e.g., through use of high-speed motors) and thereby utilize high laser pulse rates, can frequently utilize a single laser as an imaging source.

EXAMPLES

In the following Examples 1 to 6, imaging layers were prepared by casting, drying and curing the following precursor compositions on polyester films (such as the MELINEX 331 film provided by DuPont Teijin Films, Wilmington, DE) at 4.5 g/m$^2$ (Examples 1–3) and 4.5±0.5 g/m$^2$ (Examples 4–6) to yield layers having thicknesses of about 2 and 2+ $\mu$m, respectively. Silicone coatings were then applied as disclosed in '737 at the rate of 2 g/m$^2$ to yield a 2 $\mu$m thick top layer.

The precursor compositions comprise the following components:

1) a nitrocellulose polymer,
2) a carbon-black absorber (examples 1–3), or a soluble dye absorber (examples 4–6),
3) a crosslinker (such as any of the CYMEL products provided by American Cyanamid Company, Wayne, N.J.),
4) a catalyst to promote crosslinking of the polymer,
5) a high load of white pigment titanium dioxide, and
6) a solvent for the application of the above components to the substrate.

TABLE 1

| Imaging Layer Precursor Compositions Components | Example 1 | Example 2 | Example 3 |
|---|---|---|---|
| | (Parts by weight) | | |
| 5–6" RS Nitrocellulose | 7.5 | 7.5 | 7.5 |
| Vulcan XC-72 | 3.8 | 2.6 | 1.5 |
| N-propyl acetate | 5.7 | 5.7 | 5.7 |
| CYMEL 303 | 3.0 | 3.0 | 3.0 |
| NACURE 2530 (catalyst) | 3.0 | 3.0 | 3.0 |
| TRONOX CR-837 ($TiO_2$) | 22.5 | 22.5 | 22.5 |
| Methyl Ethyl Ketone (2-butanone) | 104.5 | 105.7 | 106.8 |
| Total parts | 150.0 | 150.0 | 150.0 |

TABLE 2

| Imaging Layer Precursor Compositions Components | Example 4 | Example 5 | Example 6 |
|---|---|---|---|
| | (Parts by weight) | | |
| 5–6" RS Nitrocellulose | 5.0 | 5.0 | 5.0 |
| IR-810 | 0.5 | 0.5 | 0.5 |
| N-propylacetate | 4.5 | 4.5 | 4.5 |
| CYMEL 303 | 2.0 | 2.0 | 2.0 |
| NACURE 2530 (catalyst) | 2.0 | 2.0 | 2.0 |
| TRONOX CR-837 ($TiO_2$) | 15.0 | 20.0 | 25.0 |
| Methyl Ethyl Ketone (2-butanone) | 71.0 | 71.0 | 71.0 |
| Total parts | 100.0 | 105.0 | 110.0 |

CYMEL 303 is a crosslinking agent provided by American Cyanamid Company, Wayne, N.J. NACURE 2530 is a catalyst is provided by King Industries, Inc., Norwalk, Connecticut. TRONOX CR-837 is a titanium dioxide pigment provided by American Potash & Chemical, Los Angeles, Calif. IR-810 is an IR-absorbing dye obtained from Eastman Fine Chemicals, Eastman Kodak Co., Rochester, N.Y.

Varying the concentration of carbon black (Vulcan XC-72) in examples 1–3 had an insignificant effect on layer morphology and imaging. It did, however, affect the visible color of the imaging layer; a darker gray was obtained at higher content, whereas a lighter gray was obtained at lower content. Layer morphology of the plates from Examples 1–3 is comparable to that observed of plates from Examples 4–6.

It will therefore be seen that the foregoing techniques and constructions result in lithographic printing plates with superior printing and performance characteristics. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method for imaging a lithographic printing member, the method comprising the steps of:

a. providing a printing member comprising a first layer; an imaging layer over the first layer, the imaging layer comprising a polymeric material and, dispersed therein, a radiation-scattering material and a radiation-absorbing material; and a topmost layer, the topmost layer and the first layer having opposite affinities for ink or a liquid to which ink will not adhere;

b. selectively exposing at least a portion of the printing member to laser radiation in a pattern representing an image so as to substantially ablate the imaging layer, thereby removing or facilitating removal of the topmost layer; and c. cleaning the printing member to remove remaining portions of the imaging layer and the topmost layer where the printing member received radiation.

2. The imaging method of claim 1, wherein the radiation-scattering material is in particulate form.

3. The imaging method of claim 1, wherein the radiation-scattering material is a metal oxide.

4. The imaging method of claim 1, wherein the radiation-scattering material is selected from the group consisting of titanium dioxide, tin dioxide, and zirconium dioxide.

5. The imaging method of claim 1, wherein the radiation-scattering material reflects IR radiation.

6. The imaging method of claim 1, wherein the radiation-absorbing material is carbon black.

7. The imaging method of claim 1, wherein the imaging layer is porous.

8. The imaging method of claim 1, wherein the radiation-absorbing material absorbs IR radiation.

9. The imaging method of claim 1, wherein the first layer of the printing member is oleophilic and the topmost layer is oleophobic.

10. The imaging method of claim 9, wherein the imaging layer is also oleophilic.

11. The imaging method of claim 1, wherein the first layer of the printing member is oleophilic and the topmost layer is hydrophilic.

12. The imaging method of claim 11, wherein the imaging layer is also oleophilic.

13. A lithographic printing member comprising:

a. a first layer;

b. an imaging layer over the first layer, the imaging layer comprising a polymeric material and, dispersed therein, a radiation-scattering material, and
a radiation-absorbing material; and c. a topmost layer, the topmost layer and the first layer having opposite affinities for ink or a liquid to which ink will not adhere.

14. The printing member of claim 13, wherein the radiation-scattering material is a metal oxide.

15. The printing member of claim 14, wherein the radiation-scattering material is particulate.

16. The printing member of claim 13, wherein the radiation-scattering material is selected from the group consisting of titanium dioxide, tin dioxide, and zirconium dioxide.

17. The printing member of claim 13, wherein the radiation-scattering material is silica.

18. The printing member of claim 13, wherein the radiation-scattering material reflects IR radiation.

19. The printing member of claim 13, wherein the radiation-absorbing material is carbon black.

20. The printing member of claim 13, wherein the imaging layer is porous.

21. The printing member of claim 13, wherein the radiation-absorbing material absorbs IR radiation.

22. The printing member of claim 13, further comprising a substrate layer beneath the first layer.

23. The printing member of claim 13, wherein the first layer is oleophilic and the topmost layer is oleophobic.

24. The printing member of claim 23, wherein the imaging layer is also oleophilic.

25. The printing member of claim 23, wherein the topmost layer is silicone.

26. The printing member of claim 13, wherein the first layer of the printing member is oleophilic and the topmost layer is hydrophilic.

27. The printing member of claim 26, wherein the imaging layer is also oleophilic.

28. The printing member of claim 26, wherein topmost layer is polyvinyl alcohol.

29. The printing member of claim 13, wherein the polymeric material of the imaging layer comprises nitrocellulose.

30. The printing member of claim 13, wherein the first layer is a polyester film.

31. The printing member of claim 13, wherein the radiation-scattering material is a hydrated form of titanium oxide or silica and forms chemical bonds with the topmost layer.

32. The printing member of claim 13, wherein the radiation-scattering material is a reflective metal.

33. The printing member of claim 13, wherein the radiation-scattering material comprises pigment particles surrounded by a reflective coating.

34. The printing member of claim 13, wherein the imaging layer comprises a polymeric binder.

35. The printing member of claim 13, wherein the imaging layer mechanically interlocks with at least the topmost layer.

* * * * *